US006720298B2

(12) United States Patent
Blything et al.

(10) Patent No.: US 6,720,298 B2
(45) Date of Patent: Apr. 13, 2004

(54) DETERGENT COMPOSITIONS COMPRISING AN ETHOXYLATED ALCOHOL AND ALKYL IOENZENE SULFONATE

(75) Inventors: Sandra Ann Blything, Wirral (GB); Amrat Paul Singh, Wirral (GB); Thelma Christine Titley, Wirral (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/013,790

(22) Filed: Dec. 11, 2001

(65) Prior Publication Data

US 2002/0137656 A1 Sep. 26, 2002

(30) Foreign Application Priority Data

Dec. 15, 2000 (GB) ..... 0030671

(51) Int. Cl.[7] ..... C11D 1/83

(52) U.S. Cl. ..... 510/351; 510/276; 510/356; 510/357; 510/421; 510/426; 510/445

(58) Field of Search ..... 510/276, 351, 510/356, 357, 421, 426, 445

(56) References Cited

U.S. PATENT DOCUMENTS

| | | | | | |
|---|---|---|---|---|---|
| 3,684,723 | A | * | 8/1972 | Best et al. | 252/132 |
| 3,983,078 | A | | 9/1976 | Collins | 252/540 |
| 4,083,794 | A | * | 4/1978 | Lee et al. | 252/99 |
| 4,259,200 | A | * | 3/1981 | Sims et al. | 252/102 |
| 4,292,191 | A | * | 9/1981 | Gray | 252/99 |
| 4,294,711 | A | | 10/1981 | Hardy et al. | 252/8.75 |
| 4,298,492 | A | * | 11/1981 | Van Den Brom | 252/97 |
| 4,818,422 | A | * | 4/1989 | Adams et al. | 252/8.8 |
| 4,876,023 | A | | 10/1989 | Dickenson et al. | 252/90 |
| 5,476,608 | A | * | 12/1995 | Boyer et al. | 252/135 |
| 5,559,091 | A | | 9/1996 | Geboes et al. | 510/422 |
| 5,668,100 | A | * | 9/1997 | Schmid et al. | 510/446 |
| 5,900,396 | A | | 5/1999 | Cala et al. | 510/351 |
| 6,087,313 | A | * | 7/2000 | Ardia et al. | 510/309 |
| 6,440,926 | B1 | * | 8/2002 | Spadoni et al. | 510/445 |

FOREIGN PATENT DOCUMENTS

| | | |
|---|---|---|
| DE | 43 13 949 | 11/1994 |
| DE | 43 20 851 | 1/1995 |
| EP | 000 225 | 1/1979 |
| EP | 142 910 | 5/1985 |
| EP | 164 072 | 12/1985 |
| EP | 287 343 | 10/1988 |
| EP | 293 139 | 11/1988 |
| EP | 495 345 | 7/1992 |
| GB | 2 279 660 | 1/1995 |
| WO | 92/18594 | 10/1992 |
| WO | 93/02176 | 2/1993 |
| WO | 93/19148 | 9/1993 |
| WO | 94/16052 | 7/1994 |
| WO | 97/43364 | 11/1997 |
| WO | 97/43365 | 11/1997 |
| WO | 97/43371 | 11/1997 |
| WO | 97/43387 | 11/1997 |
| WO | 97/43389 | 11/1997 |
| WO | 97/43390 | 11/1997 |
| WO | 97/43391 | 11/1997 |
| WO | 97/43393 | 11/1997 |
| WO | 98/17769 | 4/1998 |
| WO | 98/18892 | 5/1998 |

OTHER PUBLICATIONS

PCT International Search Report in a PCT application: PCT/GB 02/04154.
Derwent Abstract of DE 43 13 949 published Nov. 3, 1994.
Derwent Abstract of EP 164 072 published Dec. 11, 1985.
PCT International Search Report in a PCT application PCT/GB 02/04122.
Derwent Abstract of DE 43 20 851 published Jan. 5, 1995.
GB Search Report in a GB application GB 0030671.2.
GB Search Report in a GB application GB 0030669.6.
BASF Technical Information Bulletin, *Lutensol AO types*, Oct. 1995.
Co–pending Application: Applicant: Singh et al., Ser. No.: 10/013,754, Filed: Dec. 11, 2001.
PCT International Search Report in a PCT application PCT/EP 01/14488.

* cited by examiner

*Primary Examiner*—Charles Boyer
(74) *Attorney, Agent, or Firm*—Rimma Mitelman

(57) ABSTRACT

A built laundry detergent composition contains anionic surfactant in combination with a minor amount of a highly ethoxylated nonionic surfactant which is a $C_8$–$C_{16}$ alcohol ethoxylated with an average of from 20 to 50 ethylene oxide groups. The composition exhibits improved oily soil detergency especially under hard water conditions.

10 Claims, No Drawings

DETERGENT COMPOSITIONS COMPRISING AN ETHOXYLATED ALCOHOL AND ALKYL IOENZENE SULFONATE

TECHNICAL FIELD

The present invention relates to laundry detergent compositions containing a combination of anionic and specified nonionic surfactants giving improved oily soil detergency, especially under hard water conditions.

BACKGROUND

Heavy duty laundry detergent compositions have for many years contained anionic sulphonate or sulphate surfactant, for example, linear alkylbenzene sulphonate (LAS), together with ethoxylated nonionic surfactants. Examples abound in the published literature.

The preferred ethoxylated alcohol nonionic surfactants giving an optimum balance of properties have generally been those having an alkyl chain length of $C_{12}$–$C_{15}$ and an average degree of ethoxylation of 1 to 10, preferably 3 to 7, more preferably about 5.

Longer-chain alcohols having a higher degree of ethoxylation, for example, tallow alcohol ($C_{18}$) 11EO, have also been used.

These relatively hydrophobic materials of low HLB value are generally liquids at ambient temperature and exhibit excellent oily soil removal.

Longer-chain alcohols having higher degrees of ethoxylation, for example, tallow ($C_{18}$) alcohol 25EO and 50EO, are solids at ambient temperature and are used as slowly dissolving coating materials, for example, for enzyme or antifoam granules.

It has now surprisingly been found that ethoxylated alcohols combining a shorter alkyl chain length and a higher degree of ethoxylation, when used in minor amounts together with an anionic sulphonate or sulphate surfactant, can give enhanced oily soil removal. The benefit is especially great under hard water conditions.

PRIOR ART

WO 94 16052A (Unilever) discloses high bulk density laundry powders based on LAS and conventional nonionic surfactants, and containing small amounts of very highly ethoxylated alcohols, eg tallow alcohol 80EO, as a dissolution aid.

EP 293 139A (Procter & Gamble) discloses twin-compartment sachets containing detergent powders. Some powders contain very small amounts of tallow alcohol 25EO.

WO 93 02176A (Henkel) discloses the use of highly ethoxylated aliphatic alcohols as "structure breakers" in high bulk density powders containing conventional nonionic surfactants.

U.S. Pat. No. 4,294,711 (Procter & Gamble) discloses a textile softening heavy duty detergent composition containing 1 wt % of tallow alcohol 80EO.

WO 92 18594A (Procter & Gamble) discloses builder granules of layered silicate coated with tallow alcohol 50EO.

EP 142 910A and EP 495 345A (Procter & Gamble) disclose antifoam granules containing highly ethoxylated alcohols.

WO 93 19148A (Procter & Gamble) discloses liquid hard surface cleaning compositions containing highly ethoxylated nonionic surfactants optionally plus anionic surfactant.

GB 2 279 660A (Procter & Gamble) discloses a liquid laundry detergent composition containing a solid water-insoluble organic peroxyacid bleach and a $C_8$–$C_{20}$ 2–20EO ethoxylated alcohol nonionic surfactant, but only lower ethoxylates (9EO and below) are specifically disclosed.

WO 98 18892A (Du Pont) discloses a carpet cleaning formulation containing a $C_{10}$–$C_{16}$ ethoxylated alcohol of HLB value 10.5–15.

DEFINITION OF THE INVENTION

The present invention provides a built laundry detergent composition comprising (i) from 5 to 40 wt %, preferably from 7 to 30 wt %, of surfactant consisting essentially of:

(i)(a) from 60 to 99 wt %, preferably from 80 to 95 wt %, based on the surfactant (i), of anionic sulphonate or sulphate surfactant, (i)(b) from 1 to 40 wt %, preferably from 5 to 20 wt %, based on the surfactant (i), of an ethoxylated alcohol nonionic surfactant of the formula $$R—(—O—CH_2—CH_2)_n—OH$$

wherein R is a hydrocarbyl chain having from 8 to 16 carbon atoms, and the average degree of ethoxylation n is from 20 to 50, (ii) from 10 to 80 wt % of detergency builder, (iii) optionally other detergent ingredients to 100 wt %.

The invention also provides a process for laundering textile fabrics by machine or hand, which includes the step of immersing the fabrics in a wash liquor comprising water in which a laundry detergent composition as defined in the previous paragraph is dissolved or dispersed, wherein the water has a hardness of at least 20 degrees (French).

The invention further provides the use of a surfactant (i) consisting essentially of (i)(a) from 60 to 99 wt %, preferably from 80 to 95 wt %, based on the surfactant (i), of anionic sulphonate or sulphate surfactant, (i)(b) from 1 to 40 wt %, preferably from 5 to 20 wt %, based on the surfactant (i), of an ethoxylated alcohol nonionic surfactant of the formula $$R—(—O—CH_2—CH_2)_n—OH$$

wherein R is a hydrocarbyl chain having from 8 to 16 carbon atoms, and the average degree of ethoxylation n is from 20 to 50, in a laundry detergent composition in an amount of from 5 to 40 wt %, to improve the oily soil detergency of the composition especially in water having a hardness of at least 20 degrees (French).

DETAILED DESCRIPTION OF THE INVENTION

Detergent compositions of the invention provide increased detergency on oily soils, especially under hard water conditions, for example, using water of a hardness of at least 20 degrees (French). The benefit is especially apparent at very high water hardnesses, for example, more than 30 degrees (French).

The Surfactant Combination (i)

The detergent compositions of the invention contain a combination of an anionic sulphonate or sulphate surfactant, and a defined nonionic surfactant. The total amount of the two surfactants is from 5 to 40 wt %, preferably from 7 to 30 wt %.

The surfactant combination consists essentially of from 60 to 99 wt %, preferably from 80 to 95 wt % and more preferably from 85 to 95 wt %, of anionic sulphonate or sulphate detergent, and from 1 to 40 wt %, preferably from 5 to 20 wt % and more preferably from 5 to 15 wt %, of the defined nonionic surfactant.

In the compositions of the invention, the weight ratio of anionic surfactant (i)(a) to nonionic surfactant (i)(b) is from 2:1 to 25:1, preferably from 3:1 to 20:1. Especially good results are obtained when the ratio is from 5:1 to 10:1.

The whole product (composition) preferably contains:

(i)(a) from 3 to 30 wt %, preferably from 5 to 25 wt %, of the anionic sulphonate or sulphate surfactant, and (i)(b) from 0.5 to 10 wt %, preferably from 1 to 5 wt %, of the nonionic surfactant (i)(b).

Optionally minor, non-interfering amounts of other surfactants may also be present. Preferably, however, the composition is free from nonionic surfactants other than the defined nonionic surfactant (i)(b).

More preferably the composition is substantially free of other non-soap surfactants.

Optionally soap may also be present, for example, in an amount of from 1 to 5 wt %.

The Anionic Surfactant (i)(a)

The anionic surfactant is a sulphonate or sulphate anionic surfactant.

Anionic surfactants are well-known to those skilled in the art. Many suitable detergent-active compounds are available and are fully described in the literature, for example, in "Surface-Active Agents and Detergents", Volumes I and II, by Schwartz, Perry and Berch.

Examples include alkylbenzene sulphonates, primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Preferably the anionic surfactant is linear alkylbenzene sulphonate or primary alcohol sulphate. More preferably the anionic surfactant is linear alkylbenzene sulphonate.

The Ethoxylated Nonionic Surfactant (i)(b)

The nonionic surfactant is an ethoxylated aliphatic alcohol of the formula $$R—(—O—CH_2—CH_2)_n—OH$$

wherein R is a hydrocarbyl chain having from 8 to 16 carbon atoms, and the average degree of ethoxylation n is from 20 to 50.

The hydrocarbyl chain, which is preferably saturated, preferably contains from 10 to 16 carbon atoms, more preferably from 12 to 15 carbon atoms. In commercial materials containing a spread of chain lengths, these figures represent an average.

The alcohol may be derived from natural or synthetic feedstock. Preferred alcohol feedstocks are coconut, predominantly $C_{12}$–$C_{14}$, and oxo $C_{12}$–$C_{15}$ alcohols. Longer chain materials such as tallow or hardened tallow ($C_{18}$) are not preferred.

The average degree of ethoxylation ranges from 20 to 50, preferably from 25 to 40.

Preferred materials have an average alkyl chain length of $C_{12}$–$C_{16}$ and an average degree of ethoxylation of 25 to 40.

An example of a suitable commercially available material is Lutensol (Trade Mark) A030, ex BASF, which is a $C_{13}$–$C_{15}$ alcohol having an average degree of ethoxylation of 30.

Detergency Builder (ii)

The compositions may suitably contain from 10 to 80%, preferably from 15 to 70% by weight, of detergency builder. Preferably, the quantity of builder is in the range of from 15 to 50% by weight.

Preferably the builder is selected from sodium tripolyphosphate, zeolite, sodium carbonate, sodium citrate, layered silicate, and combinations of these.

The zeolite used as a builder may be the commercially available zeolite A (zeolite 4A) now widely used in laundry detergent powders. Alternatively, the zeolite may be maximum aluminium zeolite P (zeolite MAP) as described and claimed in EP 384 070B (Unilever), and commercially available as Doucil (Trade Mark) A24 from Ineos Silicas Ltd, UK. Zeolite MAP is defined as an alkali metal aluminosilicate of zeolite P type having a silicon to aluminium ratio not exceeding 1.33, preferably within the range of from 0.90 to 1.33, preferably within the range of from 0.90 to 1.20. Especially preferred is zeolite MAP having a silicon to aluminium ratio not exceeding 1.07, more preferably about 1.00. The particle size of the zeolite is not critical. Zeolite A or zeolite MAP of any suitable particle size may be used.

Also preferred according to the present invention are phosphate builders, especially sodium tripolyphosphate. This may be used in combination with sodium orthophosphate, and/or sodium pyrophosphate.

Other inorganic builders that may be present additionally or alternatively include sodium carbonate, layered silicate, amorphous aluminosilicates.

Organic builders that may be present include polycarboxylate polymers such as polyacrylates and acrylic/maleic copolymers; polyaspartates; monomeric polycarboxylates such as citrates, gluconates, oxydisuccinates, glycerol mono-di- and trisuccinates, carboxymethyloxysuccinates, carboxy-methyloxymalonates, dipicolinates, hydroxyethyliminodiacetates, alkyl- and alkenylmalonates and succinates; and sulphonated fatty acid salts.

Organic builders may be used in minor amounts as supplements to inorganic builders such as phosphates and zeolites. Especially preferred supplementary organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Other Detergent Ingredients

As well as the surfactants and builders discussed above, the compositions may optionally contain bleaching components and other active ingredients to enhance performance and properties.

These optional ingredients may include, but are not limited to, any one or more of the following: soap, peroxyacid and persalt bleaches, bleach activators, sequestrants, cellulose ethers and esters, other antiredeposition agents, sodium sulphate, sodium silicate, sodium chloride, calcium chloride, sodium bicarbonate, other inorganic salts, fluorescers, photobleaches, polyvinyl pyrrolidone, other dye transfer inhibiting polymers, foam controllers, foam boosters, acrylic and acrylic/maleic polymers, proteases, lipases, cellulases, amylases, other detergent enzymes, citric acid, soil release polymers, fabric conditioning compounds, coloured speckles, and perfume.

Detergent compositions according to the invention may suitably contain a bleach system. The bleach system is preferably based on peroxy bleach compounds, for example, inorganic persalts or organic peroxyacids, capable of yielding hydrogen peroxide in aqueous solution. Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate. Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED). Also of interest are peroxybenzoic acid precursors, in particular, N,N,N-trimethylammonium toluoyloxy benzene sulphonate.

A bleach stabiliser (heavy metal sequestrant) may also be present. Suitable bleach stabilisers include ethylenediamine tetraacetate (EDTA) and the polyphosphonates such as Dequest (Trade Mark), EDTMP.

The detergent compositions may also contain one or more enzymes. Suitable enzymes include the proteases, amylases, cellulases, oxidases, peroxidases and lipases usable for incorporation in detergent compositions.

In particulate detergent compositions, detergency enzymes are commonly employed in granular form in amounts of from about 0.1 to about 3.0 wt %. However, any suitable physical form of enzyme may be used in any effective amount.

Antiredeposition agents, for example cellulose esters and ethers, for example sodium carboxymethyl cellulose, may also be present.

The compositions may also contain soil release polymers, for example sulphonated and unsulphonated PET/POET polymers, both end-capped and non-end-capped, and polyethylene glycol/polyvinyl alcohol graft copolymers such as Sokolan (Trade Mark) HP22. Especially preferred soil release polymers are the sulphonated non-end-capped polyesters described and claimed in WO 95 32997A (Rhodia Chimie).

Product Form and Preparation

The compositions of the invention may be of any suitable physical form, for example, particulates (powders, granules, tablets), liquids, pastes, gels or bars.

According to one especially preferred embodiment of the invention, the detergent composition is in particulate form.

Powders of low to moderate bulk density may be prepared by spray-drying a slurry, and optionally postdosing (dry-mixing) further ingredients. "Concentrated" or "compact" powders may be prepared by mixing and granulating processes, for example, using a high-speed mixer/granulator, or other non-tower processes.

Tablets may be prepared by compacting powders, especially "concentrated" powders.

Also preferred are liquid detergent compositions, which may be prepared by admixing the essential and optional ingredients in any desired order to provide compositions containing the ingredients in the the requisite concentrations.

EXAMPLES

The invention is illustrated in further detail by the following non-limiting Examples, in which parts and percentages are by weight unless otherwise stated.

Examples 1 to 4, Comparative Example A

Performance Appraisal of Anionic/Nonionic Surfactant Mixtures on Kitchen Grease Soil in Hard Water Surfactant mixtures were prepared by mixing sodium linear alkylbenzene sulphonate (LAS) and the ethoxylated nonionic surfactant Lutensol AO30 (R=$C_{12}$–$C_{15}$ alkyl, n has an average value of 30), in various proportions ranging from 95:5 (19:1) to 80:20 (4:1).

Medium suds detergent compositions suitable for the machine wash were prepared to the following general formulation:

| | |
|---|---|
| Total surfactant (LAS plus nonionic) | 16.00 |
| Sodium tripolyphosphate | 34.00 |
| Sodium carboxymethyl cellulose | 0.50 |
| Sodium silicate | 7.00 |
| Sodium hydroxide | 0.45 |
| Sodium chloride | 2.00 |
| Fluorescers | 0.15 |
| Silicone fluid antifoam | 0.05 |
| Acrylic polymer | 1.00 |
| Sodium aluminosilicate | 0.50 |
| Sodium carbonate | 3.58 |
| Sodium perborate tetrahydrate | 7.67 |
| Tetracetyl ethylenediamine | 2.21 |
| Enzyme granules | 1.64 |
| Soil release polymer | 0.35 |
| Citric acid | 1.00 |
| Antifoam granules | 3.00 |
| Coloured speckles (sodium tripolyphosphate) | 1.80 |
| Perfume | 0.33 |
| Miscellaneous salts, water etc | to 100 |

Soil removal performance on knitted polyviscose fabrics was measured in a tergotometer test. The soil used was soya bean oil (chosen as a typical greasy kitchen soil), coloured with a violet dye (0.08 wt %) to act as a visual indicator.

Test cloths (10 cm×10 cm), each soiled with 0.5 ml of violet-dyed soya bean oil, were washed in tergotometers using the detergent compositions above under the following conditions:

| | |
|---|---|
| Temperature | 25° C. |
| Liquor to cloth ratio | 30:1 |
| Product dosage | 2.0 g/l |
| Water hardness (° French) | 40 |
| Soak time | 10 min |
| Wash time (agitation) | 15 min |

These conditions corresponded to a $pK_{Ca}^{2+}$ of 4.0.

The reflectance ΔE, indicative of total colour change (of the violet dye) across the whole visible spectrum, of each test cloth was measured before and after the wash. The results expressed as the difference ΔΔE between reflectance values ΔE before and after the wash are shown in the following table. These results are averaged over 2 replicates.

| | wt % of total surfactant | | Ratio | ΔΔE | | |
|---|---|---|---|---|---|---|
| Example | LAS | Nonionic AO30 | LAS: nonionic | Exp 1 | Exp 2 | Mean ΔΔΔE |
| A | 100 | 0 | — | 14.9 | 13.4 | — |
| 1 | 95 | 5 | 19:1 | 17.2 | 15.7 | +2.3 |
| 2 | 90 | 10 | 9:1 | 18.3 | 17.6 | +3.8 |
| 3 | 85 | 15 | 5.67:1 | 19.0 | 18.1 | +4.4 |
| 4 | 80 | 20 | 4:1 | 15.7 | 16.8 | +4.2 |

Examples 5 and 6: Particulate Detergent Compositions

Example 5 is a low suds formulation suitable for use in a closed drum washing machine. Example 6 is a high suds formulation suitable for use in a top-loading washing machine or for washing by hand.

| | 5 | 6 |
|---|---|---|
| LAS | 7.80 | 20.40 |
| Nonionic (Lutensol AO30) | 2.00 | 3.60 |
| Total surfactant (LAS plus nonionic) | 9.80 | 24.00 |
| Ratio LAS:nonionic (:1) | 3.90 | 5.67 |
| Soap | 4.00 | — |
| Sodium tripolyphosphate | 25.00 | 14.50 |
| Sodium carboxymethyl cellulose | 0.50 | 0.33 |
| Sodium neutral silicate | 8.96 | 6.98 |
| Sodium sulphate | 22.84 | 17.75 |
| Fluorescers | 0.13 | 0.19 |
| Acrylic/maleic copolymer | — | 1.50 |
| Sodium carbonate | 5.31 | 15.00 |
| Sodium perborate monohydrate | 5.84 | 8.00 |
| Tetracetyl ethylenediamine | 2.10 | 2.40 |
| Phosphonate sequestrant | 0.50 | 0.40 |
| Enzyme granules | 0.97 | 0.91 |
| Antifoam granules | 2.00 | — |
| Soil release polymer | 0.50 | 0.80 |
| Perfume | 0.36 | 0.30 |
| Miscellaneous salts, water etc | to 100 | to 100 |

We claim:

1. A built laundry detergent composition comprising (i) from 5 to 40 wt % of surfactant consisting essentially of:

(i)(a) from 60 to 99 wt %, based on the surfactant (i), of linear alkyl benzene sulfonate surfactant, (i)(b) from 1 to 40 wt %, based on the surfactant (i), of an ethoxylated alcohol nonionic surfactant of the formula $$R—(—O—CH_2—CH_2)_n—OH$$

wherein R is a hydrocarbyl chain having from 12 to 15 carbon atoms, and the average degree of ethoxylation n is from 25 to 40, wherein the ratio of the anionic surfactant (i)(a) to the ethoxylated nonionic surfactant (i)(b) is within the range of from 5:1 to 10:1, (ii) from 10 to 40 wt % of detergency builder, (iii) optionally other detergent ingredients to 100 wt %.

2. A detergent composition as claimed in claim 1, which comprises from 7 to 30 wt % of the surfactant (i).

3. A detergent composition as claimed in claim 1, which comprises from 80 to 95 wt %, based on the surfactant (i), of the anionic sulfonate surfactant (i)(a).

4. A detergent composition as claimed in claim 1, which comprises from 5 to 20 wt %, based on the surfactant (i), of the ethoxylated alcohol nonionic surfactant (i)(b).

5. A detergent composition as claimed in claim 1, which comprises from 3 to 30 wt % of the anionic surfactant (i)(a), and from 0.5 to 10 wt % of the nonionic surfactant (i)(b), the percentages being based on the composition.

6. A detergent composition as claimed in claim 5, which comprises from 5 to 25 wt % of the anionic surfactant (i)(a), and from 1 to 5 wt % of the nonionic surfactant (i)(b), the percentages being based on the composition.

7. A detergent composition as claimed in claim 1, wherein the detergency builder (ii) is selected from the group consisting of sodium tripolyphosphate, zeolites, sodium carbonate, sodium citrate, layered silicate, and combinations thereof.

8. A detergent composition as claimed in claim 1, which comprises one or more optional ingredients (iii) selected from the group consisting of soaps, peroxyacid and persalt bleaches, bleach activators, sequestrants, cellulose ethers and esters, other antiredeposition agents, sodium sulfate, sodium silicate, sodium chloride, calcium chloride, sodium bicarbonate, other inorganic salts, fluorescers, photobleaches, polyvinyl pyrrolidone, other dye transfer inhibiting polymers, foam controllers, foam boosters, acrylic and acrylic/maleic polymers, proteases, lipases, cellulases, amylases, other detergent enzymes, citric acid, soil release polymers, fabric conditioning compounds, coloured speckles, and perfume.

9. A detergent composition as claimed in claim 1, which is in powder form.

10. A process for laundering textile fabrics by machine or hand, which includes the step of immersing the fabrics in a wash liquor comprising water having a hardness of at least 20 degrees (French) in which a laundry detergent composition as claimed in claim 1 is dissolved or dispersed.

* * * * *